US006291758B1

(12) United States Patent
Turner

(10) Patent No.: US 6,291,758 B1
(45) **Date of Patent: *Sep. 18, 2001**

(54) PICK-UP FOR ELECTRIC GUITARS

(75) Inventor: William T. Turner, Chino Hills, CA (US)

(73) Assignee: Fender Musical Instruments Corporation, Scottsdale, AZ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/014,839

(22) Filed: Jan. 28, 1998

(51) Int. Cl.[7] ..... G10H 3/14; G10H 3/18; H01F 27/26

(52) U.S. Cl. ..... 84/726; 84/728; 336/110; 336/220; 336/221

(58) Field of Search ..... 84/726–728; 336/84 R, 336/110, 220, 221

(56) References Cited

U.S. PATENT DOCUMENTS

| | | | | |
|---|---|---|---|---|
| 3,916,751 | * | 11/1975 | Stich | 84/728 |
| 4,283,982 | * | 8/1981 | Armstrong | 84/728 |
| 4,442,749 | * | 4/1984 | Di Marzio et al. | 84/728 |
| 4,524,667 | * | 6/1985 | Duncan | 84/728 |
| 5,168,117 | | 12/1992 | Anderson . | |
| 5,834,999 | * | 11/1998 | Kinman | 84/728 X |

* cited by examiner

*Primary Examiner*—Stanley J. Witkowski
(74) *Attorney, Agent, or Firm*—Stradling Yocca Carlson & Rauth

(57) ABSTRACT

A pickup has an upper bobbin which is elongated along a longitudinal plane, a lower bobbin which is elongated along the longitudinal plane, permanent magnetic pole pieces situated within holes in the upper and lower bobbins, screws holding said bobbins together, a lower winding wound longitudinally around the lower bobbin, and a single, uniformally flat non-magnetized ferromagnetic plate having opposing ends. The ends are parallel to the longitudinal plane and terminate in a plane approximately below the upper winding. The plate is completely dispose beneath the bobbins and parallel thereto.

13 Claims, 1 Drawing Sheet

PICK-UP FOR ELECTRIC GUITARS

BACKGROUND OF THE INVENTION

It is well known that a pickup consisting of a single monolithic coil will pick up stray electromagnetic radiation and transmit this radiation (when coupled to a musical instrument amplifier) in the form of noise, which is audible as low frequency 60 HZ hum. There is also electrostatic noise, in the form of high frequency buzzing, at the pickup's resonant peak frequency. By combining a pair of coils as employed in the humbucking pickup principle, the audible noise factor is considerably reduced but not completely eliminated. As shown in U.S. Pat. No. 4,442,749, the humbucking principle can be applied in a pickup with the coils arranged in a concentric configuration, with a metal plate formed into a U shaped channel common only to the upper coil section of the pickup. This configuration is inductively unbalanced, which compromises the noise reduction capability of the pickup.

SUMMARY OF THE INVENTION

The present invention in one of its aspects has symmetrically balanced coils arranged in a concentric configuration, with a ferromagnetic steel plate centrally common to both coils; it incorporates the humbucking pickup principle for maximum noise immunity.

There is an improved means for increasing the volume of magnetic flux through the coils of the pickup, which correspondingly increases the output voltage and signal amplitude of the pickup.

There is an improved means for adding or subtracting inductive components to enhance the sound and tonal characteristics of the pickup, without compromising noise immunity.

There is an improved means for incorporating magnetic pole pieces of varying length in the pickup to control the output, balance, and sensitivity for varying diameter musical strings.

There is an improved means for increasing isolation between the pickup coils to reduce phase cancellation of common frequencies, which allows the pickup to exhibit an improved harmonic content for richer sound and tonal quality.

DETAILED DESCRIPTION OF THE PREFERRED EMBODIMENT

Figure 3:
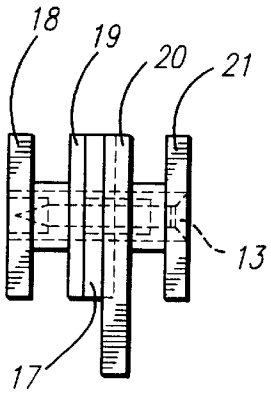
FIG. 3 is an end elevation as viewed from the right in FIG. 1, the coils being unshown.
Figure 2:
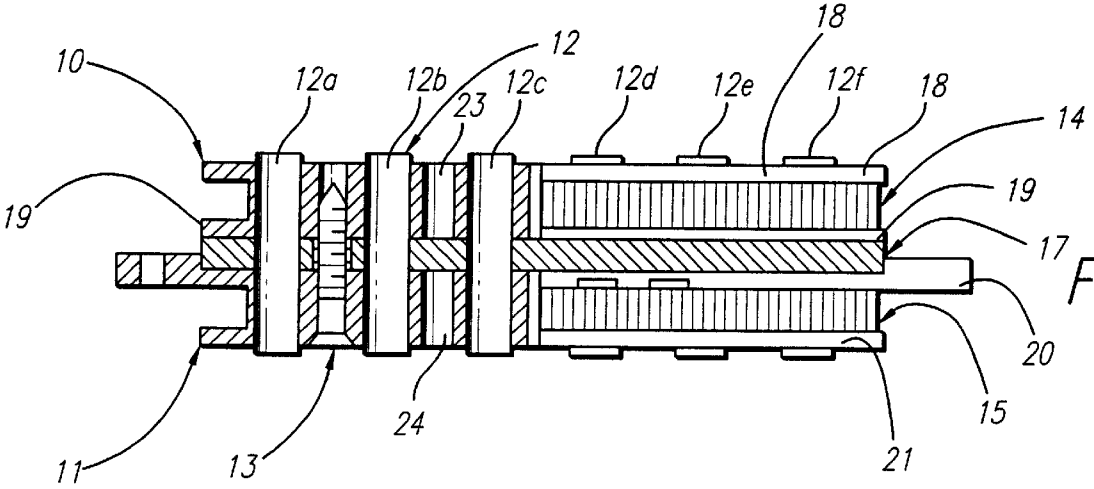
FIG. 2 is a view, the right half of which is in side elevation and the left half of which is in vertical central section, of the pickup.

The illustrated embodiment is symmetrical about a vertical plane that is perpendicular to the longitudinal axis of the pickup and that is midway between the ends of the pickup.

The illustrated pickup is for a six-string electric guitar.

The core assembly of the pickup comprises an upper bobbin section, a centrally located ferromagnetic steel plate, and a lower bobbin section. Fastening screws, of ferromagnetic material, are inserted through the bobbin core at the base of the lower bobbin section. The fastening screws extend upward from the lower bobbin section. A central steel plate is provided with corresponding apertures to engage the fastening screws. The fastening screws may pass through the apertures in the plate, the apertures in the plate being of a greater diameter than the major diameter of the screw. The plate engages the upper planar surface of the lower bobbin section.

The fastening screws extend upward through the plate to receive the upper bobbin section. The upper bobbin section engages the plate at the lower planar surface of the upper bobbin section. The screws are then fastened into the upper bobbin section, coupling the upper and lower bobbin sections together with the plate interposing the upper face section of the lower bobbin and the lower face section of the upper bobbin.

Each bobbin section has a plurality of circular apertures which extend and align through the central core of the upper and lower bobbin sections to receive a plurality of corresponding rod type magnetic pole pieces. The plate has a plurality of corresponding circular apertures which align with the circular apertures in the upper and lower bobbin sections.

The circular apertures in the plate have a plurality of smaller apertures adjacent to the circular apertures for the purpose of receiving the fastening screws and additional ferromagnetic steel pole pieces.

The magnetic pole pieces are of sufficient length to extend fully through the upper and lower bobbin sections.

The magnetic pole pieces are flush at the base of the lower bobbin section and extend upwardly through the upper bobbin, projecting a short distance above the upper bobbin section surface, being positioned above the upper bobbin surface in an echelon arrangement.

The pickup shown in the drawings comprises an upper bobbin 10, a lower bobbin 11, six permanent magnet pole pieces 12, screws 13, upper and lower windings 14 and 15, and a ferromagnetic steel plate 17.

Upper bobbin 10 and lower bobbin 11 are formed of nonmagnetic material and nonmagnetizable material, preferably a synthetic resin. Upper bobbin 10 has upper and lower plates between which the upper winding is wound in a particular direction, for example clockwise as viewed from above. These plates are identical to each other in the illustrated embodiment, although this is not necessary. Lower bobbin 11 has upper and lower plates also parallel to each other, the upper plate in the preferred form being much larger than the lower and forming a skirt which is used for mounting purposes. The upper and lower plates of upper bobbin 10 are numbered 18 and 19, respectively. The skirt plate and lower plate of lower bobbin 11 are numbered 20 and 21, respectively.

The six permanent magnet pole pieces 12*a*, 12*b*, 12*c*, 12*d*, 12*e*, 12*f* are mounted parallel to each other in registered holes in upper and lower bobbins 10 and 11, as shown. The magnetic poles of the pole pieces correspond to each other. Thus, for example, all of the north poles are uppermost and all of the south poles are lowermost.

The steel screws 13 are secured in internally threaded holes in the upper and lower bobbins 10,11, and not only hold the bobbins together with each other and with the ferromagnetic steel plate, but also alter the inductance of the pickup. Thus, they serve two purposes.

There are holes 23 in the bobbins, between pole pieces 12*b* and 12*c*, and 12*d* and 12*e*.

Figure 1:
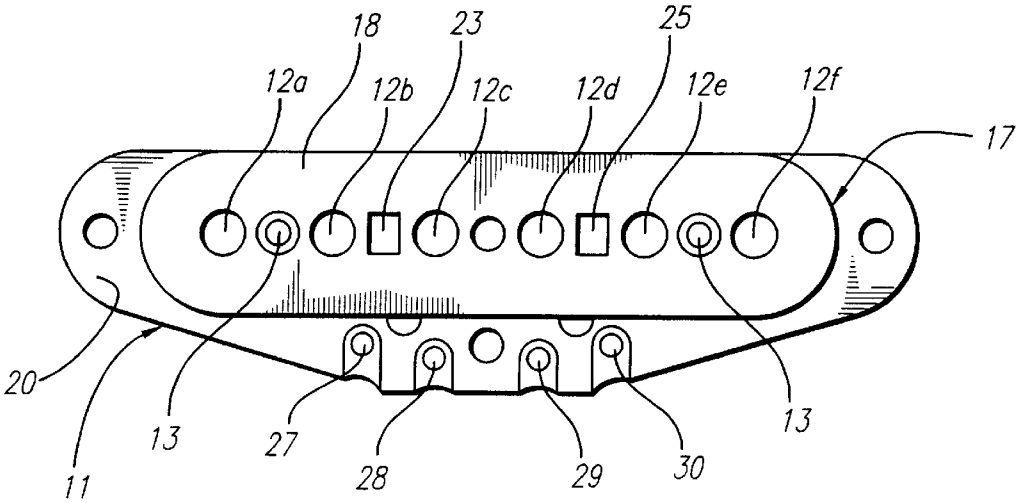
FIG. 1 is a top plan view of an electromagnetic pickup embodying the present invention.

There are connections (FIG. 1) 27,28,29 and 30. Two of these serve the upper coil or winding 14, and the other two serve the lower winding 15. The lower winding is wound in the opposite direction from the upper, for example counterclockwise in the illustration. Thus, there is the humbucking effect.

The ferromagnetic steel plate 17 is sandwiched between plates 19 and 20 and parallel thereto, being formed of magnetizable material. Stated more definitely, element 17 is a ferromagnetic steel plate. The steel plate has clearance holes therethrough to receive the pole pieces and the screws.

It is to be understood that ferromagnetic cylinders 26*a* and 26*b* respectively may be inserted in the holes 23,24 in order to change the inductance of the pickup. These may be changed in accordance with the desires of the musician. Stated otherwise, there may be cylinders in some holes or openings 23,24 and not in others.

The foregoing detailed description is to be clearly understood as given by way of illustration and example only, the spirit and scope of this invention being limited solely by the appended claims.

What is claimed:

1. A pickup comprising:

(a) an upper bobbin being elongated along a longitudinal plane, (b) a lower bobbin being elongated along said longitudinal plane, (c) permanent magnet pole pieces situated within holes in the upper and lower bobbins, (d) screws holding said bobbins together, (e) an upper winding wounded longitudinally around the upper bobbin, (f) a lower winding wounded longitudinally around the lower bobbin, and (g) a single, uniformly flat non-magnetized ferromagnetic plate having opposing ends, the ends parallel to said longitudinal plane and terminating in a plane approximately below said upper winding, said plate being completely disposed between said bobbins and parallel thereto.

2. The pickup of claim 1, wherein the opposing ends of said ferromagnetic plate terminate approximately above said lower winding.

3. The pickup of claim 1, wherein the ferromagnetic plate comprises a steel plate.

4. The pickup of claim 1, further including ferromagnetic screws secured in internally threaded holes in one of said bobbins, the ferromagnetic screws holding the upper and lower bobbins together, the ferromagnetic screws further altering the inductance of the pickup when secured in said holes.

5. The pickup of claim 4, wherein the ferromagnetic screws comprise steel screws.

6. The pickup of claim 1, wherein said upper bobbin includes at least one receptacle configured to receive a ferromagnetic cylinder, the ferromagnetic cylinder altering the inductance of the pickup when inserted into the receptacle.

7. A pickup comprising:

an upper bobbin elongated along a longitudinal plane;

an upper winding wounded longitudinally around the upper bobbin;

a lower bobbin elongated along the longitudinal plane;

a lower winding wounded longitudinally around the lower bobbin;

a single, uniformly flat non-magnetized ferromagnetic plate elongated along the longitudinal plane and interposed completely between and parallel to the upper and lower bobbins, said ferromagnetic pate including at least one end parallel to said longitudinal plane that terminates approximately below the upper winding; and a magnetic pole piece extending orthogonal to the longitudinal plane from the upper bobbin to the lower bobbin and through respective openings in the upper bobbin, the ferromagnetic plate, and the lower bobbin.

8. The pickup of claim 7, further including a plurality of magnetic pole pieces extending orthogonal to the longitudinal plane from the upper bobbin to the lower bobbin and through respective openings in the upper bobbin, the ferromagnetic plate, and the lower bobbin.

9. The pickup of claim 8, further including a pair of ferromagnetic screws coupled to said bobbins for holding the bobbins together, said screws extending orthogonal to the longitudinal plane from the upper bobbin to the lower bobbin and through respective openings in the upper bobbin, the ferromagnetic plate, and the lower bobbin.

10. The pickup of claim 9, wherein the upper bobbin includes at least one receptacle extending from the top of the upper bobbin towards the lower bobbin the receptacle configured to receive therein a ferromagnetic cylinder, the ferromagnetic cylinder altering the inductance of the pickup when inserted into the receptacle.

11. The pickup of claim 10, wherein the upper bobbin includes upper and lower plates that are elongated in the longitudinal plane, and wherein said lower plate abuts an upper surface of said ferromagnetic plate.

12. The pickup of claim 11, wherein the lower bobbin includes upper and lower plates that are elongated in the longitudinal plane, and wherein said upper plate of said lower bobbin abuts a lower surface of said ferromagnetic plate.

13. The pickup of claim 12, wherein the length of the second upper plate of the lower bobbin in the longitudinal direction is greater than the lower plate for forming a skirt plate.

* * * * *